US006699139B2

(12) United States Patent
Kim

(10) Patent No.: US 6,699,139 B2
(45) **Date of Patent: *Mar. 2, 2004**

(54) GOLF COLLIMATOR AND GOLF CLUB THEREWITH

(75) Inventor: Jijoong Kim, Osaka (JP)

(73) Assignee: Eben Corporation, Osaka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/396,810

(22) Filed: Mar. 26, 2003

(65) Prior Publication Data

US 2003/0186754 A1 Oct. 2, 2003

Related U.S. Application Data

(62) Division of application No. 09/891,532, filed on Jun. 27, 2001, now Pat. No. 6,561,918.

(51) Int. Cl.[7] ..... A63B 69/36

(52) U.S. Cl. ..... 473/242; 473/244; 473/249; 473/251; 473/257

(58) Field of Search ..... 473/219, 223, 473/226, 227, 238, 242, 244, 249, 251, 252, 253, 254, 257, 268, 333, 334, 335, 336, 337, 338, 339, 340, 341; 33/562, 563, 565; D21/742, 743, 744, 745, 746, 753

(56) References Cited

U.S. PATENT DOCUMENTS

| | | | |
|---|---|---|---|
| D58,209 S | 6/1921 | Bacheller | |
| 1,596,110 A | 8/1926 | Lynch | |
| 2,080,620 A | 5/1937 | Martin | |
| D140,152 S | 1/1945 | Aichele | |
| D141,691 S | 6/1945 | Miller | |
| 2,409,864 A | 10/1946 | Ingouf | |
| 3,360,268 A | 12/1967 | Molinari | |
| 3,468,545 A | 9/1969 | Anderson | |
| D312,858 S | 12/1990 | Anderson et al. | |
| 5,160,142 A | 11/1992 | Marshall | |
| 5,533,728 A | 7/1996 | Pehoski et al. | |
| 5,685,085 A | 11/1997 | Bond | |
| D393,031 S | 3/1998 | Cameron | |
| 6,296,574 B1 | 10/2001 | Kaldis | |
| 6,350,208 B1 | 2/2002 | Ford | |
| 6,394,910 B1 | 5/2002 | McCarthy | |
| 6,561,918 B2 * | 5/2003 | Kim | 473/242 |

FOREIGN PATENT DOCUMENTS

| | | |
|---|---|---|
| JP | 53-21068 | of 1978 |
| JP | 11-253590 | 9/1999 |

* cited by examiner

*Primary Examiner*—Sebastiano Passaniti
(74) *Attorney, Agent, or Firm*—Roylance, Abrams, Berdo & Goodman, L.L.P.

(57) ABSTRACT

The present invention provides: a golf collimator and a golf club therewith which make it easy for a player to ascertain a straight direction without a tense feeling when holding a golf club at the ready.

A golf collimator 1, which is a device to be fixed on a head of a golf club so as to ascertain a straight direction, comprises a recess 12 and three points arranged around the recess 12, wherein a recess 12 is of such a concave shape as is open in a direction which will be front when holding a club at the ready and as narrows the width of the recess with the approach to the bottom of the recess, and wherein the three points 13 are arranged at the back and on the right and the left of the recess. A golf club is fitted on a head with the collimator structure.

21 Claims, 6 Drawing Sheets

(a)

(b)

(a)

(b)

(a)

(b)

GOLF COLLIMATOR AND GOLF CLUB THEREWITH

This application is a divisional application of Ser. No. 09/891,532, filed Jun. 27, 2001 now U.S. Pat. No. 6,561,918.

BACKGROUND OF THE INVENTION

A. Technical Field

The present invention relates to a golf collimator which is used so as to ascertain a straight direction when holding a golf club at the ready and a golf club fitted with such a collimator.

B. Background Art

In a golf competition, a way to a good score is to ascertain a straight direction without a tense feeling when holding a golf club at the ready. If it becomes possible to ascertain a straight direction without a tense feeling also in a usual practice, it becomes possible to ascertain a straight direction without a tense feeling even when going into the competition.

When a golf player holds a golf club at the ready, he or she usually repeats a process including the steps of: firstly ascertaining a direction in which he or she wants to hit a golf ball (a front direction); and then staring at a club head, and then staring into the front direction by turning his or her eyes from the club head to the front direction; and then restarting at the club head. As is often the case with this process, in proportion as this process is repeated in order to ascertain a straight direction a tense feeling gradually rises to accumulate the strain in arms and hands, resulting in hitting the ball in an unexpected direction.

By the way, according to the knowledge of sports psychology, when looping at a thing, man intrinsically tends to conceptually grasp the thing and to establish an image of the thing on the basis of the man's empirical knowledge. So, in the natural environment where there are few straight lines like in a golf field, a player tries to image a straight line through an accumulation of negative presumptions that this is not a straight line and neither is this. Then, this work for establishing an image of a straight line is performed by the subtle function of both eyes, but the established image of a straight line varies according to days and times. Because of the occurrence of such a phenomenon, the golf player's work for ascertaining a straight line brings him or her a still tenser feeling.

SUMMARY OF THE INVENTION

A. Objects of the Invention

Therefore, in the light of the above circumstances, an object of the present invention is to provide: a golf collimator which makes it easy to ascertain a straight direction without a tense feeling when holding a golf club at the ready, and further, prevents an image of a straight line from varying according to times; and a golf club fitted with such a collimator.

B. Discrosure of the Invention

A golf collimator of the present invention for solving the above problems, which is a device to be fixed on a head of a golf club so as to ascertain a straight direction, is characterized by comprising a recess and tree points arranged around the recess, wherein the recess is of such a concave shape as is open in a direction which will be font when holding a club at the ready and as narrows the width of the recess gradually with the approach to the bottom of the recess, and wherein the three points are arranged at the back and on the tight and the left of the recess respectively.

A golf club of the present invention for solving the above problems, which is fitted with a golf collimator so as to ascertain a straight direction, is characterized by comprising a recess and three points arranged around the recess, wherein the recess is of such a concave shape as is open in a direction which will be front when holding a club at the ready and as narrows the width of the recess gradually with the approach to the bottom of the recess, and wherein the three points are arranged at the back and on the right and the left of the recess respectively.

DETAILED DESCRIPTION OF THE INVENTION

Figure 1:
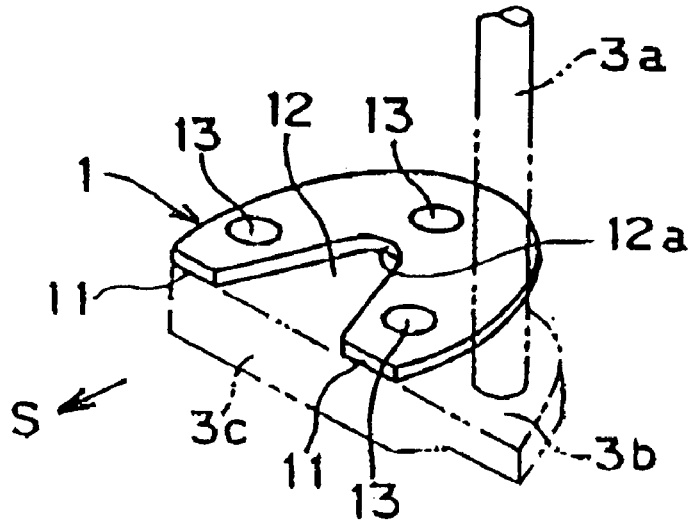
FIG. 1 is a perspective view (a) and a plan view (b), showing the one mode of carrying out a golf collimator of the present invention.
Figure 1:
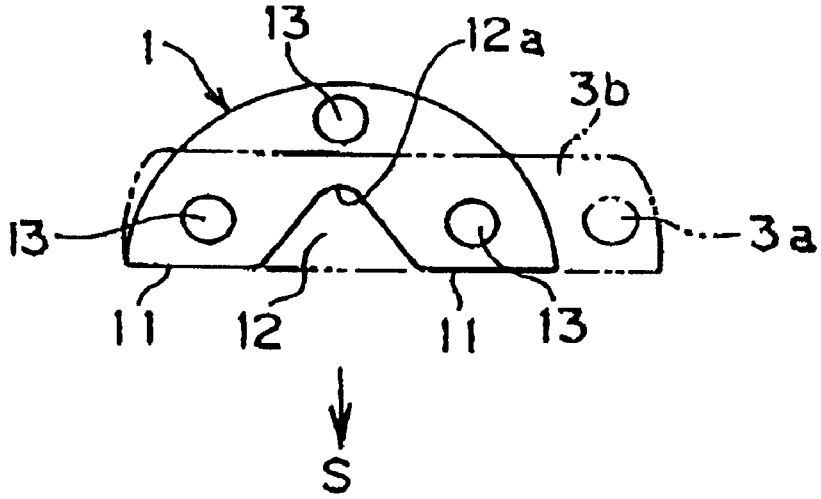

FIG. 1 shows one mode for carrying out a golf collimator of the present invention. The golf collimator 1 is a board to be fixed to the upper side of a club head 3*b* showed in a two-dotted chain line in a figure. As everybody knows, a club head 3*b* was fixed at the tip of a club shaft 3*a* shown in a two-dotted chain line in a figure. The attachment of a board 1 on a head 3*b* is possible by such a variety of ways as is to stick a board 1 on the upper side of a head 3*b* through a both-sided adhesive tapes (omitted in a figure) which are stuck on the back side of a board 1, or to screw a board 1 on a head 3*b*, whereon tapped holes (omitted in a figure) are established.

A board 1 is fitted with a linear plane 11, 11 and a notch, wherein the linear planes are located on the right and the left of a side of the board which will look toward a front (a direction showed by S in a figure) when a board 1 is fixed on a head 3*b*, and wherein the notch 12 is formed backward between the linear plane 11 and 11. A recess of the notch 12 is of such a concave shape as is open in a direction which will be the front S when holding a club at the ready, and wherein the innermost of the recess is located almost at the widthways center, and wherein three points 13 are drawn at three positions both on the upper side of the board 1 and around the notch 12 of the recess, that is, at the back and on the right and the left of the recess respectively.

Figure 2:
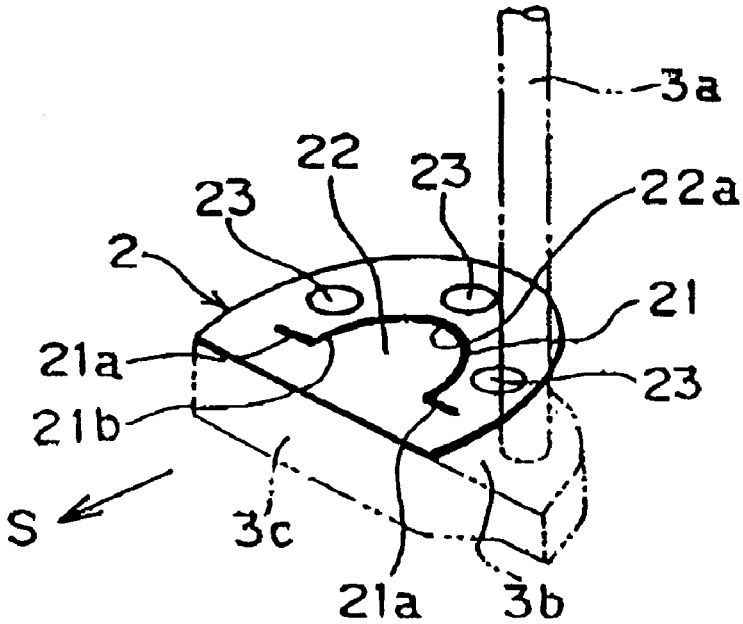
FIG. 2 is a perspective view (a) and a plan view (b), showing another mode of carrying out a golf collimator of the present invention.
Figure 2:
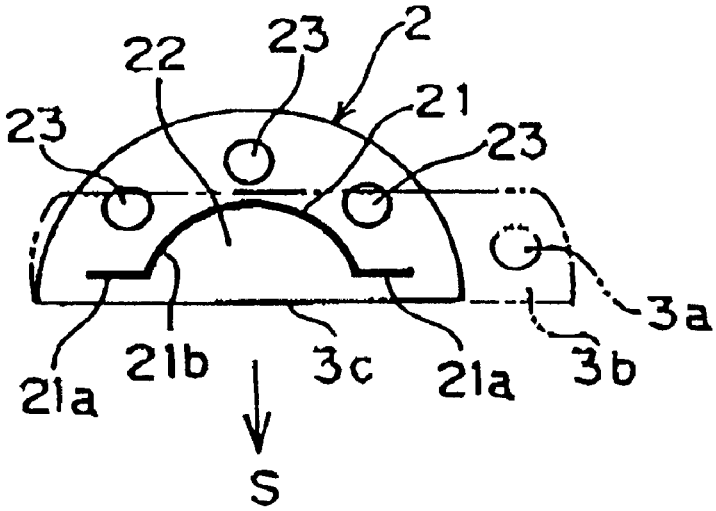

A golf collimator of the present invention can be a sheet made from paper or plastic. FIG. 2 shows such a golf collimator 2, which is a sheet to be fixed on a head 3*b* easily because the back side of the sheet is adhesive or such, whereon lines 21 are drawn on a side of the sheet which will look toward a front when the sheet is fixed on a head 3*b*. The lines 21 are composed of a straight line part 21*a* and 21*a* in the right and the left part of the lines respectively, and a curved line part which is formed by a central part 21*b* curved backward. The concave cured line part 21*b* forms one recess 22, which is of such a concave shape as is open in a direction which will be front when holding a club at the ready, and the innermost 22*a* of the recess is located almost at the widthways center. Three points 23 are drawn at three positions around a recess 22 which is formed by a concave curved line part 21*b* of the lines 21, that is, at the back and on the right and on the left of the recess respectively.

Figure 3:
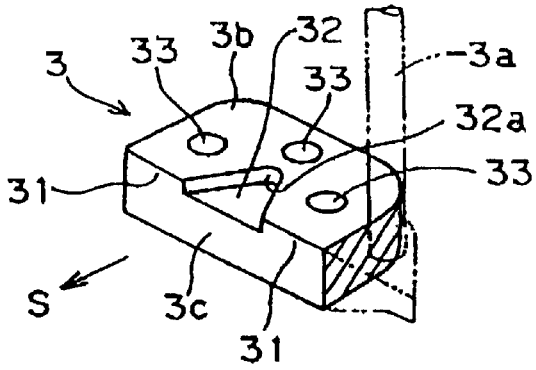
FIG. 3 is a perspective view, showing the one mode of Vying out a golf club with a collimator of the present invention.

FIG. 3 shows one mode for carrying out the present invention of a golf club with a golf collimator. The mode is applied to a putter, but a golf club therewith of the present invention can be also applied to an iron or a wood.

A putter 3 in FIG. 3 is fitted with the following structure for a collimator on the head fixed at the tip of a shaft 3*a* of the putter. That is, the collimator structure comprises a recess 32 and three points 33 arranged around the recess 32. A recess 32 is of such a concave shape as is formed by engraving on the upper side of a head 3*b* or such and as is open in a direction which will be a front S when a player overlooks a head and holds a club at the ready, and wherein the innermost 32*a* of the recess is located almost at the widthways center of the recess. The three points 33 are arranged at the back and on the night and the left of the recess 32 respectively.

The function of the above collimator structure of the present invention is described below.

Figure 4:
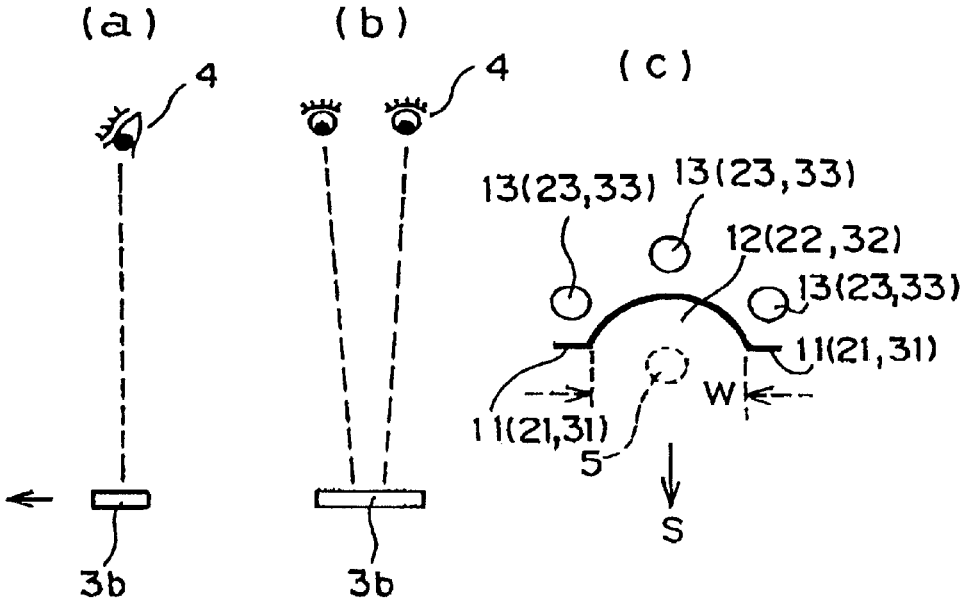
FIG. 4 is an explanatory view (a), (b), and (c), showing how to use a golf collimator and a golf club therewith of the present invention.

When a player holds a golf club with the collimator structure of the present invention at the ready and overlooks a head 3*b* with his or her eyes 4 as viewed in FIG. 4(*a*) and (*b*), he or she can look at a recess 12 (22, 32) and three points 13 (23, 33) on a club head 3*b* as viewed in FIG. 4(*c*). A player can concentrate his or her attention on the upper side of a head 3*b* easily by looking at three points 13 (23, 33) However, because there are three points and the three points scatter a player's sight, it does not lead the circumstance that a player fixes his or her eyes 4 on a head 3*b*. That is, the viewpoint of seeing a thing does not focus on a single point (hard focus), but comes to cover a slightly wide area (soft focus). As a result, three points 13 (23, 33) works to make a player concentrate his or her attention on a head 3*b* at ease. Otherwise, if there were a single point, a player cannot have such an ease feeling, and is forced to have a tense feeling.

When a player looks in a direction of a front S with concentrating his or her attention without a tense feeling, a collimator structure directs his or her eyes toward a direction which an opening of a recess 12 (22, 32) is extended to, wherein the recess is surrounded by three points 13 (23, 33), and wherein the opening of the recess will look toward a front S. Therefore, such an extension of eyes of a player enables him or her to adjust a hitting face to a front direction both easily and accurately. That is, a collimator structure enables a player to ascertain a straight direction without a tense feeling, and to adjust a hitting face to the front direction. Furthermore, a collimator structure of the present invention remarkably increases the accuracy of ascertaining a straight direction, because an opening of a recess 12, which will look toward a front S, has the width w and makes a player to ascertain a direction of a front S by means of not a simply single line, but a band with the width of w.

When a player is in the above circumstance, he or she assumes naturally as if another point 5, which is shown by a dotted line in a figure in front of the three points 13 (23, 33) of the collimator structure, has existed actually Therefore, putting a golf ball (not shown in a figure) on the point 5 enables a player to roll or hit a golf ball easily along the image of a straight line ascertained through the above process.

In the above example, an opening of a recess 12 (22, 32), which will look toward a front S, has a linear part 11 (21, 31) on the right and the left of an opening of a recess respectively, and the linear part 11 (21, 31) lies along a hitting face of a head 3*b*. Therefore, in this point a collimator structure also makes it easy and accurate to adjust a hitting face of a head 3*b* to a front S by ascertaining a straight direction.

According to the knowledge of the present inventor, some have a right dominant eye, and the others have a left dominant eye. In principle, man usually looks at a thing by means of a man's dominant eye. The strength of a man's dominant eye not only varies subtly according to days and times, also a man's dominant eye sometimes becomes the other eye. This causes the change of the image of a straight line described in the beginning. Therefore, if in order to correct a function of a man's dominant eye the innermost 12*a* (22*a*, 32*a*) of the recess 12 (22, 32) is made eccentric from the widthways center C only by a minute distance (a preferable distance is from 1 to 5 mm) as viewed in FIG. 5, it becomes possible to correct the above-mentioned image of a straight line ascertained by a man's dominant eye. In case of a right-handed player, the deviation of the innermost is better performed for a player with a right dominant eye in a downward Notion as viewed in FIG. 5, on the other hand the deviation of the innermost is better performed for a player with a left dominant eye in a upward direction as viewed in FIG. 5. On the contrary, in case of a left-handed player, the deviation of the innermost is better performed for a player with a right dominant eye in a upward direction as viewed in FIG. 5, on the other hand the deviation of the innermost is better performed for a player with a left dominant eye in a downward direction as viewed in FIG. 5.

Figure 5:
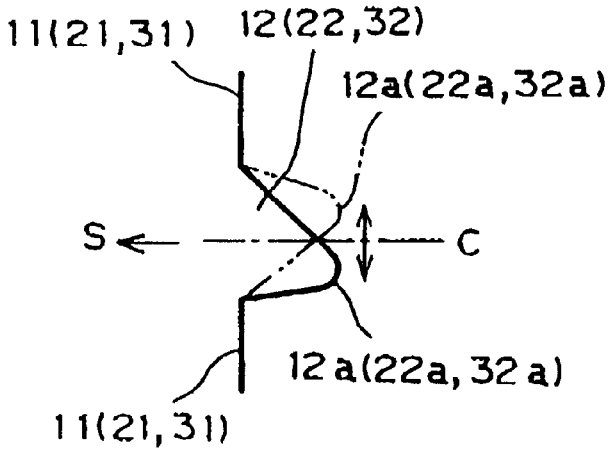
FIG. 5 is a plan view, showing the mechanism of correcting a dominant eye by a collimator structure of the present invention
Figure 6:
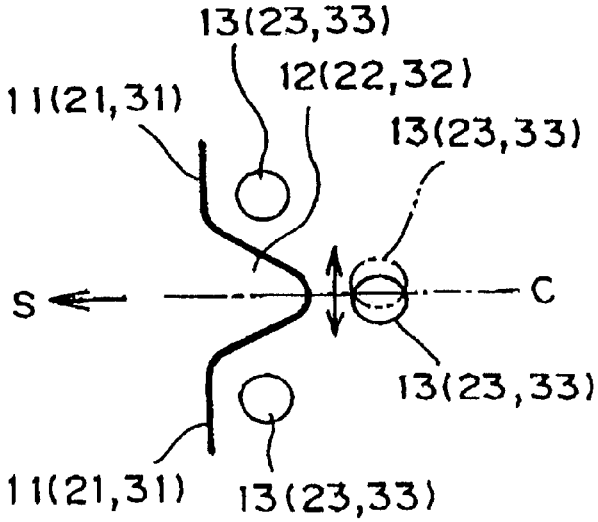
FIG. 6 is a plan view, showing another example of the mechanism of correcting a dominant eye by a collimator structure.

In FIG. 5, the correction function is shown by means of making the innermost of a recess eccentric either right or left. In addition, as viewed in FIG. 6, it is also possible to show the similar correction function by making a point 13 (23, 33), located at the back of a recess 12, eccentric slightly either right or left from the backward center C centered between two points on the right and the left. However, it is most preferred that the correction function is shown by combing the deviation of the position of the innermost with the deviation of a point at the back of a recess.

As the above result, the collimator structure of the present invention works so that a player can lower his or her score easily. According to the result of the experiment in which beginners, average level of players, and veterans used the golf collimator and the golf club therewith, they were able to lower their score by one to five on the average per ten batted balls in a putting practice.

Figure 7:
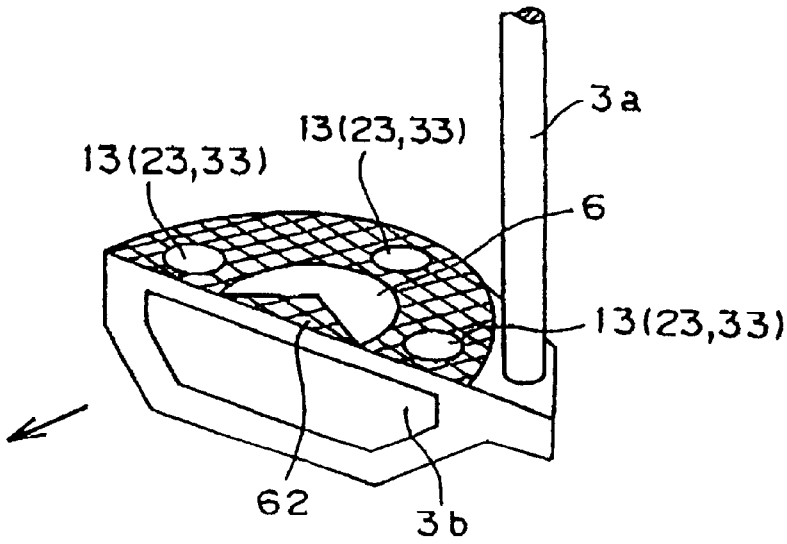
FIG. 7 is a perspective view, showing another mode of carrying out a golf club with a collimator of the present invention.

In any example of FIGS. 1–3, a recess 12 (22, 32) is fitted with a linear part 11 (21, 31) on the right and on the left of an opening of the recess respectively. These linear parts work to make it easy to adjust a hitting face 3*c* of a head 3*b* to a front S because of the existence of the linear parts. However, a collimator structure of the present invention does not necessarily require the linear parts. That is to say, for example, as is drawn by printing or such on the upper side of a head 3*b* in FIG. 7, the collimator structure may be a structure that an arc of circle 6 having the notch of about 120 degree is drawn in the region surrounded by three points 13 (23, 33), thereby king the resultant notch 62 of a triangle shape as the aforementioned recess, and that there is no rectilinear part on the right and the left of the opening of this recess 62.

A line drawn for a recess 12 (22, 32) is a continuous line in example. However, as long as a recess can be imaged, a line drawn for a recess 12 may be discontinuous like a dashed line. A recess may be drawn by printing or such, or may be formed in such a shape as is hollowed or swelling.

Figure 8:
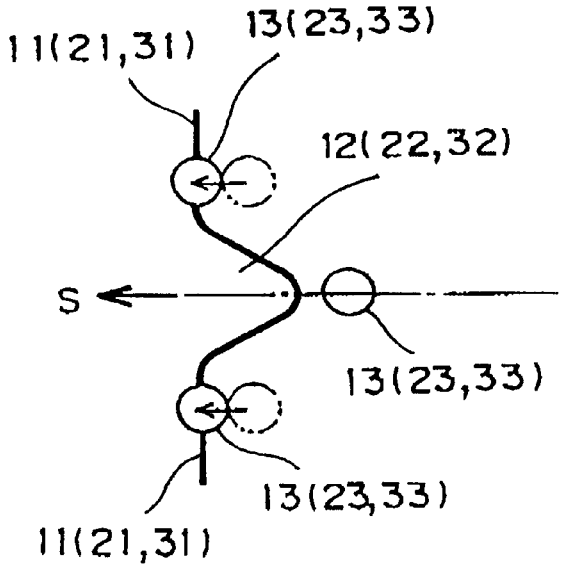
FIG. 8 is a plan view, showing another revised example of the positions of two points on the right and the left.

Three points 13 (23, 33) are essential to a collimator structure of the present invention. However, as long as two points on the right and the left are located on a line lying along a hitting face 3*c* of a head 3*b*, and as long as a central point is arranged to be located almost at the back of the center between two points, a depth position of a central point may be shallow or deep. In case where a focus of eyes is adjusted to a head by using the effect of three points on easing stare of eyes as described in the above, the degree of easing focal stare can be adjusted by alter the depth degree of the depth position of a central point. In this case, a central point By be kept apart back from the innermost of a recess. On the contrary, two points on the right and the left of a recess may be located further forward around a recess, that is, two points 13 (23, 33) and 13 (23, 33) may be projected slightly from the position of a front edge of a recess 12 (22, 32) as viewed in FIG. 8, or two points on the right and the left of a recess 12 (22, 32) ray be located slightly forward, as not shown in figure. Such an arrangement of two points on the right and the left of a recess enables to lengthen a depth distance without altering a depth position of a central point.

Three points may be drawn by printing or such, or may be formed in such a shape as is hollowed or swelling.

As long as a collimator structure of the present invention comprises such a three points and such a recess, the collimator structure may comprise more than three points, a shape except such a shape as is a point or a recess, and a structure with such.

When a golf player swings a golf head downward, he or she always swings a golf head downward with the intention to strike the center of gravity of a head with the center of a golf ball. However, it arises that the position of the center of gravity of a head does not strike upon the center of a golf ball and becomes eccentric slightly in a certain direction, either right or left This results from a physical habit that each of a golf player has. Therefore, the direction of slippage made by each of a golf player is definite. Because this slippage is minute, a general golf player is unconscious of this slippage.

If this slippage is corrected, a golf collimator structure of the present invention works more effectively. The correction of this slippage becomes possible by providing a club head with the following structure.

Figure 9:
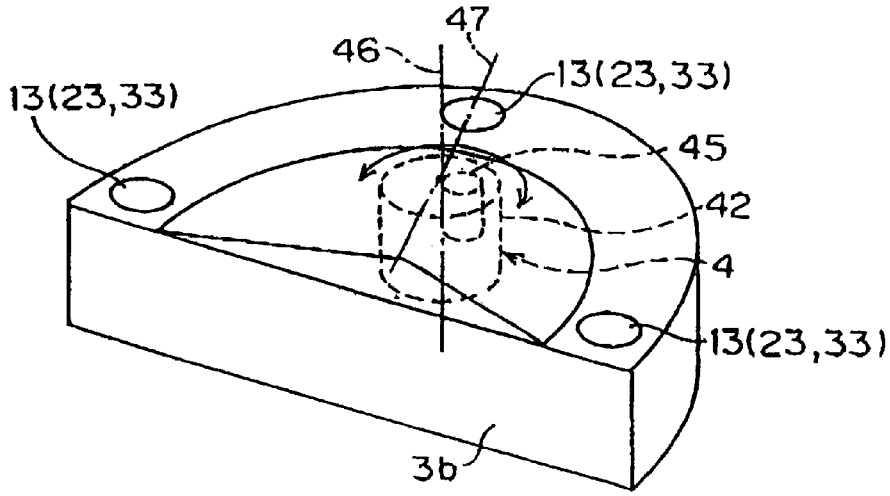
FIG. 9 is an explanatory view (a) and (b), showing another mode of carrying out the present invention.
Figure 9:
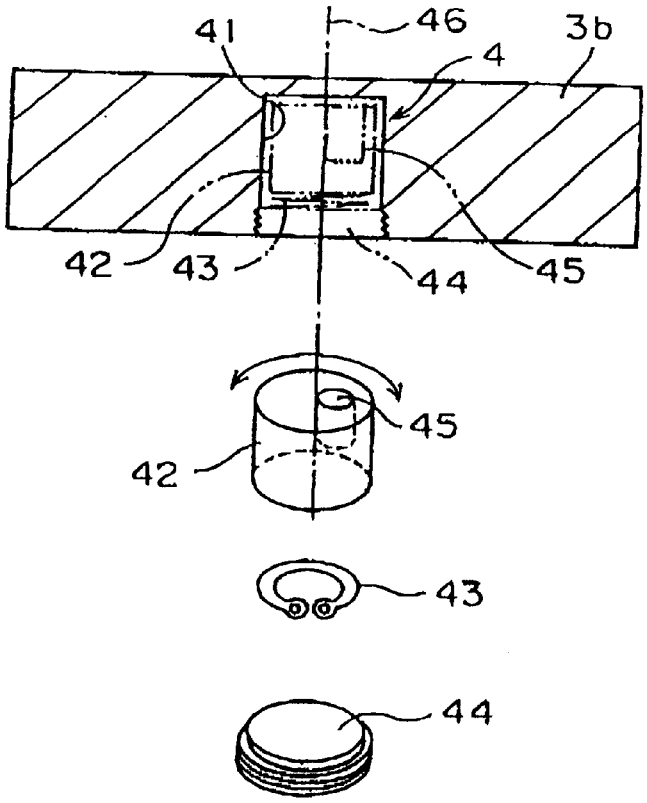

FIG. 9(*a*) shows a club head fitted with the correction structure. FIG. 9 (*b*) shows the correction structure in sections. A head 3*b* is fitted with not only a golf collimator structure of the present invention composing a circular arc 6 and three points 13 (23, 33), but also the structure 4 for correcting the center of gravity at the central portion of a head. This structure 4 has such a hole 41 as is formed by boring the central portion of a head from the bottom cylindrically, and comprises the hole 41, a cylinder 42, a spring ring 43, a screw groove 41*a*, and a screw cap 44, wherein, as is shown with a two-dotted chain line in FIG. 9(*b*), the cylinder 42, made of a lightweight aluminum alloy and the like, is settled in the hole 41 by embedding the cylinder 42 into the hole 41 and inlaying the spring ring 43 into the screw groove 41*a*, and the hole 41 is covered with the screw cap 44.

A weight 45 comprising a heavy metal such as tungsten is buried in a cylinder 42 at the eccentric state from the central line of a cylinder 42, as viewed in FIG. 9(*b*). Therefore, the center of gravity of a cylinder 42 is eccentric from the central line of a cylinder 42.

When in a hole 41 a cylinder 42 is rotated in an arrow direction or in reverse round the center of a central line 46 of a cylinder 42, the position of a weight 45 becomes eccentric either right or left from, or becomes close to the central line 47, which is directed in depth, of a head 3*b*. Therefore, the center of gravity of a head 3*b* is eccentric either right or left from the center of a head 3*b*. This slight slippage makes the above-mentioned correction possible.

It becomes also possible to make the center of gravity of a cylinder 42 eccentric from the center of a cylinder 46 not by burying a weight 45 in a cylinder 42 but by cutting the head of a cylinder 42 aslant, with the result that a similar effect can be achieved.

(Effects and Advantages of the Invention)

When a player holds a golf club at the ready, a golf collimator and a golf club therewith of the present invention make it easy to ascertain a straight direction without a tense feeling owing to the function of concentrating his or her attention which three points causes, and owing to the function of ascertaining a front direction which a recess surrounded by these points causes. Therefore, the collimator structure of the present invention enables a player to lower his or her score easily. It becomes also possible to correct the difference of the image of a straight line ascertained by a player's dominant eye by making the innermost of a recess eccentric by a minute distance from the widthways center.

The use of a golf collimator and a golf club therewith of the present invention leads that a player is also able to ascertain a straight direction without a tense feeling, even if he or she does not have the collimator structure.

What is claimed is:

1. A device for use in a state fixed on a golf club head in order to ascertain a straight direction, said device comprising a body having a dimension for removably coupling to a top face of said golf club head, wherein said body has a top face, a bottom face, a leading edge and a trailing edge and includes a first visual indicator point and a second visual indicator point arranged on a front side on said top face of said body toward said leading edge and a third visual indicator point arranged on a back side on said top face of said body toward said trailing edge, wherein:

said first and second visual indicator points on said front side are located on a right side and a left side on a line laying substantially parallel to a hitting face of said golf club head;

said third visual indicator point is located almost at a back end of a center line extending between said first and second visual indicator points; and said first, second and third visual indicator points being visually distinguishable on said top face of said body and being visually distinguishable from each other.

2. A device according to claim 1, wherein said first, second and third visually distinguishable points form a visual triangle.

3. A device according to claim 2, wherein said third visually distinguishable point forms an apex of said visual triangle whereby said triangle points toward said trailing edge.

4. A device according to claim 1, wherein said third visual indicator point is off-center from a center line extending perpendicular to said leading edge and uniformly spaced between said first visual indicator point and said second visual indicator point.

5. A device according to claim 4, wherein said third visual indicator point is oriented toward said right side with respect to said center line.

6. A device according to claim 4, wherein said third visual indicator point is oriented toward said left side with respect to said center line.

7. A device according to claim 1, wherein said first, second and third visual indicator points are printed indicia on said body.

8. A golf club having a head and a device for ascertaining a straight direction, wherein said device comprises a body having a top face, a bottom face, a leading edge and a trailing edge, said top face of said body including a first visual indicator point and a second visual indicator point arranged toward said leading edge of said body and a third visual indicator point arranged toward said trailing edge on said top face of said body, wherein:

said first and second visual indicator points are located on a right side and a left side of said body and on a line laying substantially parallel a hitting face of said golf club head;

said third visual indicator point is located almost at a back portion of a center line extending between said first and second visual indicator points; and said first, second and third visual indicator points being visually distinguishable on said top face of said body and being visually distinguishable from each other.

9. A golf club according to claim 8, wherein said third visual indicator point forms an apex of a visual triangle with said first visual indicator point and second said visual indicator point, whereby said triangle points toward said trailing edge.

10. A golf club according to claim 9, wherein said third visual indicator point is off-center from a center line extending perpendicular to said leading edge and uniformly spaced between said first visual indicator point and said second visual indicator point.

11. A golf club according to claim 10, wherein said third visual indicator point is oriented toward said right side with respect to said center line.

12. A golf club according to claim 10, wherein said third visual indicator point is oriented toward said left side with respect to said center line.

13. A golf club according to claim 8, wherein said first, second and third visual indicator points are printed indicia on said top face.

14. A golf club comprising:

a golf club head having a top face, a bottom face, a first side and a second side, said top face having a leading edge, a trailing edge, a first side edge and second side edge;

a first visually distinguishable indicator on said top face and positioned along said first side edge;

a second visually distinguishable indicator on said top face and positioned along said second side edge; and a third visually distinguishable indicator on said top face and being spaced from said first visually distinguishable indicator and said second visually distinguishable indicator and being positioned between said first and said second visually distinguishable indicators and said trailing edge, wherein said first, second and third visually distinguishable indicators are visually distinguishable from said top face and from each other.

15. The golf club of claim 14, wherein said first, second and third visually distinguishable indicators are indicia on said top face.

16. A golf club according to claim 14, wherein said third visually distinguishable indicator forms an apex of a visual triangle whereby said triangle points toward said trailing edge.

17. A golf club according to claim 14, wherein said third visually distinguishable indicator is off-center from a center line extending perpendicular to said leading edge and uniformly spaced between said first visually distinguishable indicator and said second visually distinguishable indicator.

18. A golf club and device according to claim 17, wherein said device is integrally formed with said head.

19. A golf club and device according to claim 17, wherein said device is removably coupled to said head.

20. A golf club according to claim 17, wherein said third visually distinguishable indicator is oriented toward said first side with respect to said center line.

21. A golf club according to claim 17, wherein said third visually distinguishable indicator is oriented toward said second side with respect to said center line.

* * * * *